United States Patent [19]

Agrawal et al.

[11] Patent Number: 5,006,137

[45] Date of Patent: Apr. 9, 1991

[54] NITROGEN GENERATOR WITH DUAL REBOILER/CONDENSERS IN THE LOW PRESSURE DISTILLATION COLUMN

[75] Inventors: Rakesh Agrawal, Allentown; Donald W. Woodward, New Tripoli, both of Pa.

[73] Assignee: Air Products and Chemicals, Inc., Allentown, Pa.

[21] Appl. No.: 491,756

[22] Filed: Mar. 9, 1990

[51] Int. Cl.[5] ..... F25J 3/00

[52] U.S. Cl. ..... 62/11; 62/24; 62/38; 62/44

[58] Field of Search ..... 62/11, 13, 24, 31, 32, 62/36, 38, 42, 44

[56] References Cited

U.S. PATENT DOCUMENTS

| | | | |
|---|---|---|---|
| 4,372,765 | 2/1983 | Tamura et al. | 62/29 |
| 4,400,188 | 8/1983 | Patel et al. | 62/13 |
| 4,416,677 | 11/1983 | Pahade | 62/31 |
| 4,439,220 | 3/1984 | Olszewski et al. | 62/31 |
| 4,448,595 | 5/1984 | Cheung | 62/31 |
| 4,453,957 | 9/1985 | Agrawal et al. | 62/25 |
| 4,464,188 | 8/1984 | Agrawal et al. | 62/13 |
| 4,543,115 | 6/1984 | Pahade et al. | 62/25 |
| 4,582,518 | 4/1986 | Erickson | 62/25 |
| 4,617,036 | 10/1986 | Suchdeo et al. | 62/11 |
| 4,662,916 | 5/1987 | Agrawal et al. | 62/13 |
| 4,662,917 | 5/1987 | Cormier et al. | 62/13 |
| 4,662,918 | 5/1987 | Agrawal et al. | 62/13 |
| 4,704,148 | 11/1987 | Kleinberg | 62/24 |
| 4,871,382 | 10/1989 | Thorogood et al. | 62/24 |

FOREIGN PATENT DOCUMENTS 1215377 1/1968 United Kingdom .

OTHER PUBLICATIONS

M. Ruhemann, "The Separation of Gases", Oxford Univ. Press, Second Edition, 1952.

R. E. Latimer, "Distillation of Air" Chem. Engr. Progress 63(2), 35(1967).

H. Springmann "Cryogenic Principles and Applications" Chem. Engr., 13 May 1985.

R. M. Thorogood, "Large Gas Separation and Liquefaction Plants" Cryogenic Engr. 1986.

Pahade, et al. "Nitrogen Production for EOR" 1987 Int'l Cryogenic Materials & Cryogenic Engr. Conf.

J. R. Flower, et al., "Medium Purity Oxygen Production . . . " AICHE Symposium Series, No. 224, vol. 79, 1983.

*Primary Examiner*—Ronald C. Capossela

*Attorney, Agent, or Firm*—Willard Jones, II; William F. Marsh; James C. Simmons

[57] ABSTRACT

The present invention is a cryogenic process for the production of nitrogen by distilling air in a double column distillation system comprising a high pressure column and a low pressure column. The critical step of the invention is the condensation of a nitrogen stream in the top most reboiler/condenser located in the stripping section of the low pressure column to provide column reboil and the total condensation of a portion of the compressed feed air in the bottom most reboiler/condenser located in the bottom of the low pressure column.

11 Claims, 5 Drawing Sheets

COMPRESSED AIR
10
HP GAN
25
COMPRESSED AIR
100
LP GAN
53
WASTE
57
12
14
16
18
20
22
24
26
40
42
44
46
48
50
52
54
56
58
PURGE
60
62
64
102
104
106
108
228
230
232
234
236
36

COMPRESSED AIR
10
HPGAN
25
LPGAN
53
WASTE
57
12
14
16
18
20
22
24
26
36
40
44
46
48
50
52
54
56
58
PURGE
60
62
64
228
232
234
236
370
372
374
380
382
386
388

COMPRESSED AIR
10
HP GAN
25
LP GAN
53
WASTE
57
COMPRESSED AIR
100
160
12
14
16
18
20
22
24
26
36
40
42
44
46
48
50
52
54
56
58
PURGE
60
62
102
104
106
108
228
230
232
234
236

NITROGEN GENERATOR WITH DUAL REBOILER/CONDENSERS IN THE LOW PRESSURE DISTILLATION COLUMN

TECHNICAL FIELD

The present invention is related to a process for the cryogenic distillation of air to produce large quantities of nitrogen.

BACKGROUND OF THE INVENTION

Numerous processes are known in the art for the production of large quantities of high pressure nitrogen by using cryogenic distillation; among these are the following:

The conventional double column process originally proposed by Carl Von Linde and described in detail by several others, in particular, M. Ruhemann in "The Separation of Gases" published by Oxford University Press, Second Edition, 1952., R. E. Latimer in "Distillation of Air" published in Chem. Eng. Prog., 63 (2), 35 (1967); and H. Springmann in "Cryogenics Principles and Applications" published in Chem. Eng., pp 59, May 13, 1985; is not useful when pressurized nitrogen is the only desired product. This conventional double column process was developed to produce both pure oxygen and pure nitrogen products. To achieve this end, a high pressure (HP) and a low pressure (LP) column, which are thermally linked through a reboiler/condenser, are used. To effectuate and produce a pure oxygen product stream, the LP column is run at close to ambient pressure. This low pressure of the LP column is necessary to achieve the required oxygen/argon separation with reasonable number of stages of separation.

In the conventional double column process, nitrogen is produced from the top of the LP and HP columns and oxygen from the bottom of the LP column. However, when pure nitrogen is the only desired product and there is no requirement to produce pure oxygen or argon as co-products, this conventional double column process is inefficient. A major source of the inefficiency is due to the fact that the nitrogen/oxygen distillation is relatively easy in comparison to the oxygen/argon distillation and the lower pressure of the LP column (close to ambient pressure)contributes significantly to irreversibility of the distillation- process and requires lower pressures for the other process streams, which for a given size of equipment leads to higher pressure drop losses in the plant.

Attempts have been made in the past to improve the performance of this conventional double column process by increasing the pressure of the LP column to 30–60 psia, one such attempt is disclosed by R. M. Thorogood in "Large Gas Separation and Liquefaction Plants" published in Cryogenic Engineering, editor B. A. Hands. Academic Press, London (1986). As a result of increasing the LP column pressure, the HP column pressure is increased to about 100–150 psia. Nitrogen recovery is 0.65–0.72 moles per mole of feed air. Instead of pure oxygen, an oxygen-enriched (6014 75% oxygen concentration) waste stream is withdrawn from the bottom of the LP column. Since this stream is at a pressure higher than the ambient pressure, it can be expanded to produce work and provide a portion of the needed refrigeration for the plant. Also, the LP column does not need large amounts of reboiling to produce a 60–75% oxygen stream. As a result, the efficiency of the plant is improved by producing a fraction of the nitrogen product at high pressure from the top of the HP column (about 10–20% of feed air as high pressure nitrogen), however, some major inefficiencies still remain. Since the flowrate of the oxygen-enriched waste stream is essentially fixed (0.25–0.35 moles/mole of feed air), the pressure of the oxygen-enriched waste stream is dictated by the refrigeration requirements of the plant; thus dictating the corresponding pressure of the LP column. Any attempt to further increase the pressure of the LP column to reduce the distillation irreversibilities leads to excess refrigeration across the turboexpander., thus causing overall higher specific power requirements. Another inefficiency in this process is the fact that a large quantity of the oxygen-enriched liquid needs to be reboiled in the LP column reboiler/condenser. These large quantities mean a large temperature variation on the boiling side of the reboiler/condenser compared to the fairly constant temperature on the condensing side for the pure nitrogen; thus contributing to higher irreversible losses across the reboiler/condenser.

U.S. Pat. No. 4,617,036 discloses a process which addresses some of the above describe inefficiencies by using two reboiler/condensers. In this arrangement, other than withdrawing an oxygen-enrich waste stream as vapor from the Lottom of LP column, the oxygen-enriched waste stream is withdrawn as a liquid. This liquid stream is then reduced in pressure across a Joule-Thompson (JT) valve and vaporized in a separate external boiler/condenser against a condensing portion of the high pressure nitrogen stream from the top of the HP column. The vaporized oxygen-rich stream is then expanded across a turboexpander to produce work and provide a portion of the needed refrigeration. Reboil of the LP column is provided in two stages, thereby, decreasing the irreversibility across the reboiler/condenser, as is reflected in the fact that for the same feed air pressure, the LP column operates at a higher pressure, about 10–15 psi. As a result, the portion of nitrogen product collected from the top of the LP column is also increased in pressure by the same amount. This leads to a savings in energy for the product nitrogen compressor.

A similar process is disclosed in United Kingdom Patent No. GB 1,215,377, a flowsheet derived from this process is shown in FIG. 1. Like U.S. Pat. No. 4,617,036, this process collects an oxygen-rich waste stream as liquid from the bottom of the LP column and vaporizes it in an external reboiler/condenser. The condensing fluid, however, is low pressure nitrogen (40–65 psia) from the top of the LP column. The condensed nitrogen is returned as reflux to the top of the LP column thus decreasing the need for pure nitrogen reflux derived from the HP column. In turn, more gaseous nitrogen can be recovered as product from the top of the HP column (30–40% of the feed air stream) making the process more energy efficient. Furthermore, the condensation of LP column nitrogen against the oxygen-enriched waste stream allows for an increase in the pressure of both the distillation columns. Which, in turn, makes these columns operate more efficiently and results in higher pressure nitrogen product streams. The increased pressure of these product streams along with the increased pressure of the feed air stream together result in lower pressure drop losses which further contributes to process efficiency.

Another similar process is disclosed in U.S. Pat. No. 4,453,957.

A detailed study of the above two processes is given by Pahade and Ziemer in their paper "Nitrogen Production For EOR" presented at the 1987 International Cryogenic Materials and Cryogenic Engineering Conference.

U.S. Pat. No. 4,439,220 discloses a variation on the process of GB 1,215,377 wherein rather than reboiling the LP column with high pressure nitrogen from the top of the HP column, the pressure of the crude liquid oxygen from the bottom of the HP column is decreased and vaporized against the high pressure nitrogen. The vaporized stream forms a vapor feed to the bottom of the LP column. The liquid withdrawn from the bottom of the LP column is the oxygen-enriched waste stream, similar to the process shown in FIG. 1, which is then vaporized against the condensing LP column nitrogen. A drawback of this process is that the liquid waste stream leaving the bottom of the LP column is essentially in equilibrium with the vaporized liquid leaving the bottom of the HP column. The liquid leaving the bottom of the HP column is essentially in equilibrium with the feed air stream and therefore oxygen concentrations F are typically about 35%. This limits the concentration of oxygen in the waste stream to below 60% and leads to lower recoveries of nitrogen in comparison to the process of GB 1,215,377.

A more efficient process is disclosed in U.S. Pat. No. 4,543,115. In this process, feed air is fed as two streams at different pressures. The higher pressure air stream is fed to the HP column and the lower pressure air is fed to the LP column. The reboiler/condenser arrangement is similar to GB 1,215,377, however, no high pressure nitrogen is withdrawn as product from the top of the HP column and therefore the nitrogen product is produced at a single pressure close to the pressure of the LP column. This process is specially attractive when all the nitrogen product is needed at a pressure lower than the HP column pressure (40–70 psia).

The processes described so far have a large irreversible losses in the bottom section of the LP column, which is primarily due to reboiling large quantities of impure liquid across the bottom LP column reboiler/-condenser, leading to substantial temperature variations across the reboiler/condenser on the boiling side., the temperature on the nitrogen condensing side is constant. This, in turn, leads to large temperature differences between condensing and boiling sides in certain sections of reboiler/condenser heat exchanger and contributes to the inefficiency of the system. Additionally, the amount of vapor generated at the bottom of the LP column is more than is needed for the efficient stripping in this section to produce oxygen-enriched liquid (70% $O_2$) from this column. This leads to large changes in concentration across each theoretical stage in the stripping section and contributes to the overall inefficiency of the system.

When an impure oxygen stream is withdrawn from the bottom of a LP column of a double column distillation system, the use of two or more reboilers in the bottom section of the LP column to improve the distillation efficiency has been disclosed by J. R. Flower, et al. in "Medium Purity Oxygen Production and Reduced Energy Consumption in Low Temperature Distillation of Air" published in AICHE Symposium Series Number 224, Volume 79, pp4 (1983) and in U.S. Pat. No. 4,372,765. Both use intermediate reboiler/condensers in the LP column and partially vaporize liquid at intermediate heights of the LP column. The vapor condensed in the top-most intermediate reboiler/condenser is the nitrogen from the top of the HP column. The lower intermediate reboiler/condensers condense a stream from the lower heights of the HP column with the bottom most reboiler/condenser getting the condensing stream from the lowest position of the HP column. In certain instances, the bottom most reboiler/condenser heat duty for reboiling is provided by condensing a part of the feed air stream as is disclosed in U.S. Pat. No. 4,410,343. When nitrogen from the top of the HP column is condensed in an intermediate reboiler/condenser, it can be condensed at a lower temperature and therefore its pressure is lower as compared to its condensation in the bottom most reboiler/condenser. This decreases the pressure of the HP column and hence of the feed air stream and leads to power savings in the main air compressor.

Attempts to extend the above concept of savings for impure oxygen production with multiple reboiler/condensers in the bottom section of the LP column to the nitrogen production cycles have been disclosed in U.S. Pat. Nos. 4,448,595 and 4,582,518. In U.S. Pat. No. 4,448,595, the pressure of the oxygen-rich liquid is reduced from the bottom of the HP column to the LP column pressure and boiled against the high pressure nitrogen from the top of the HP column in a reboiler/-condenser. The reboiled vapor is fed to an intermediate location in the LP column. This step operates in principle like obtaining a liquid stream from the LP column of a composition similar to the oxygen-rich liquid from the bottom of the HP column, boiling it and feeding it back to the LP column. However, the situation in U.S. Pat. No. 4,448,595 is worse than feeding oxygen-rich liquid from the bottom of the HP column to the LP column and then through an intermediate reboiler/condenser partially vaporize a portion of the liquid stream to create the same amount of vapor stream in the LP column, thus decreasing the irreversible losses across this reboiler/condenser. Furthermore, feeding oxygen-rich liquid from the HP column to the LP column provides another degree of freedom to locate the intermediate reboiler/condenser at an optimal location in the LP column rather than boiling a fluid whose composition is fixed within a narrow range (335% $O_2$). U.S. Pat. 4,582,518 does exactly the same. In the process, the oxygen-rich liquid is fed from the bottom of the HP column to the LP column and is boiled at an intermediate location of the LP column with an internal reboiler/condenser located at the optimal stage.

On the other hand, U.S. Pat. No. 4,582,518 suffers from another inefficiency. A maJor fraction of the feed air is fed to the reboiler/condenser located at the bottom of the LP column, however, only a fraction of this air to the reboiler/condenser is condensed. The two phase stream from this reboiler/condenser is fed to a separator. The liquid from this separator is mixed with crude liquid oxygen from the bottom of the HP column and is fed to the LP column. The vapor from this separator forms the feed to the HP column. The process uses only pure nitrogen liquid to reflux both columns; no impure reflux is used. As a result, a large fraction of the nitrogen product is produced at low pressure from the feed air and any benefits gained from the decreased main air compressor pressure is eliminated in the product nitrogen compressors.

Both U.S. Pat. Nos. 4,448,595 and 4,582,518 in following the principles developed for impure oxygen production have succeeded in reducing the pressure of the HP column and therefore the lowering the discharge pressure of the air from the main air compressor. However, they introduce other inefficiencies which substantially increase the proportion of low pressure nitrogen from the cold box. This saves power on the main air compressor but does not provide the lowest energy high pressure nitrogen needed for enhanced oil recovery (pressure generally greater than 500 psia). In short, neither of these two U.S. Pat. Nos. is successful in fully exploiting the potential of multiple reboiler/condensers in the stripping section of the LP column.

In addition to the double column nitrogen generators described above, considerable work has been done on single column nitrogen generators, which are disclosed in U.S. Pat. Nos. 4,400,188, 4,464,188, 4,662,916, 4,662,917 and 4,662,918. These processes of these patents use one or more recirculating heat pump fluids to provide the boilup at the bottom of the single columns and supplement the nitrogen reflux needs. Use of multiple reboiler/condensers and prudent use of heat pump fluids make these processes quite efficient. However, the inefficiencies associated with the large quantities of recirculating heat pump fluids contribute to the overall inefficiency of the system and these processes are no more efficient than the most efficient double column processes described above from the literature.

Due to the fact that energy requirement of these large nitrogen plants is a maJor component of the cost of the nitrogen, it is highly desirable to have plants which can economically further improve the efficiency of the nitrogen production.

SUMMARY OF THE INVENTION

The present invention relates to a cryogenic process for the production of nitrogen by distilling air in a double column distillation system comprising a high pressure column and a low pressure column. The present invention is best described in reference to two embodiments.

In the first embodiment, a first compressed feed air stream is cooled to near its dew point and rectified in the high pressure distillation column to produce a high pressure nitrogen overhead and a crude oxygen bottoms liquid. The crude oxygen bottoms liquid is removed from the high pressure distillation column, subcooled and fed to an intermediate location of the low pressure column for distillation. The high pressure nitrogen overhead is removed from the high pressure column and divided a first and second portion. The first portion of the high pressure nitrogen overhead is condensed in an intermediate reboiler/condenser located in the upper portion of the stripping section of the low pressure column thereby providing at least a portion of the heat duty to reboil the low pressure column. The second portion of the high pressure nitrogen overhead is warmed to recover refrigeration and removed as a high pressure nitrogen product. The high pressure column is refluxed with at least a portion of the condensed nitrogen generated above. A second compressed feed air stream is totally condensed in a reboiler/condenser located in the bottom of the low pressure column and divided into two substreams. The first substream is fed to a lower intermediate location of the high pressure column for distillation, while the second substream is reduced in pressure and fed to an upper intermediate location of the low pressure column for distillation. Finally, a low pressure nitrogen stream is removed from the top of the low pressure column, warmed to recover refrigeration and recovered from the process as a low pressure nitrogen product.

In the second embodiment, a compressed feed air stream is cooled to near its dew point and divided into two substreams. The first substream is partially condensed in a reboiler/condenser located in the bottom of the low pressure column and rectified in the high pressure distillation column thereby producing a high pressure nitrogen overhead and a crude oxygen bottoms liquid. The second substream is totally condensed in a reboiler/condenser located in lower section of the low pressure column at least one distillation stage immediately above the reboiler/condenser in the bottom of the low pressure column. The condensed, second substream is split into two parts, a first part which is fed to a lower intermediate location of the high pressure column for distillation and a second part which is reduced in pressure and fed to an upper intermediate location of the low pressure column for distillation. The crude oxygen bottoms liquid is removed from the high pressure distillation column, subcooled and fed to an intermediate location of the low pressure column for distillation. The high pressure nitrogen overhead is removed from the high pressure column and divided a first and second portion. The first portion of the high pressure nitrogen overhead is condensed in an intermediate reboiler/condenser located in the upper portion of the stripping section of the low pressure column thereby providing at least a portion of the heat duty to reboil the low pressure column. The second portion of the high pressure nitrogen overhead is warmed to recover refrigeration and removed as a high pressure nitrogen product. The high pressure column is refluxed with at least a portion of the condensed nitrogen generated above. Finally, a low pressure nitrogen stream is removed from the top of the low pressure column, warmed to recover refrigeration and recovered from the process as a low pressure nitrogen product.

As further definition of the two embodiments, in each embodiment, a portion of the cooled, compressed feed air can be removed and expanded to generate work, and the expanded portion can be further cooled and fed to an intermediate location of the low pressure column for distillation. Also, the expanded portion can be warmed to recover refrigeration and then vented as waste.

As still a further definition of the two embodiments, in each embodiment, an oxygen-enriched bottoms liquid is removed from the bottom of the low pressure column; vaporized in a reboiler/condenser located in the top of the low pressure column against condensing low pressure nitrogen overhead thereby creating a oxygen-waste stream., and warmed to recover refrigeration. Also, the warmed, oxygen-waste stream can be expanded to product work., and further warmed to recover any remaining refrigeration.

BEST AVAILABLE COP

DETAILED DESCRIPTION OF THE INVENTION

The process of the present invention relates to a nitrogen generator with at least two reboiler/condensers in the bottom section of the LP column of a double column distillation system. These reboiler/condensers are located at different heights with several distillation trays or stages between them. A high pressure nitrogen stream from the top of the HP column is condensed in the upper of these reboiler/condensers; a portion of the feed air is totally condensed in the lower of these reboiler/condensers. The feed air condensing reboiler/condenser is located in the bottom of the LP column. The condensed nitrogen stream from the upper reboiler/condenser provides the needed reflux for the HP and LP columns. Similarly, the totally condensed feed air stream is used to provide impure reflux to the HP column. In a preferred mode, the condensed air stream is split in two fractions and is used to provide impure reflux to both the HP and LP columns.

The preferred double distillation column system for this invention also uses a reboiler/condenser located at the top of the LP column. In this top reboiler/condenser, an oxygen-enriched liquid stream which is withdrawn from the bottom of the LP column is vaporized in heat exchange against a condensing nitrogen stream derived from the top of the LP column, which is returned as reflux to the LP column. With this as background, the process of the present invention will now be described in detail with reference to FIGS. 3 and 4.

Figure 3:
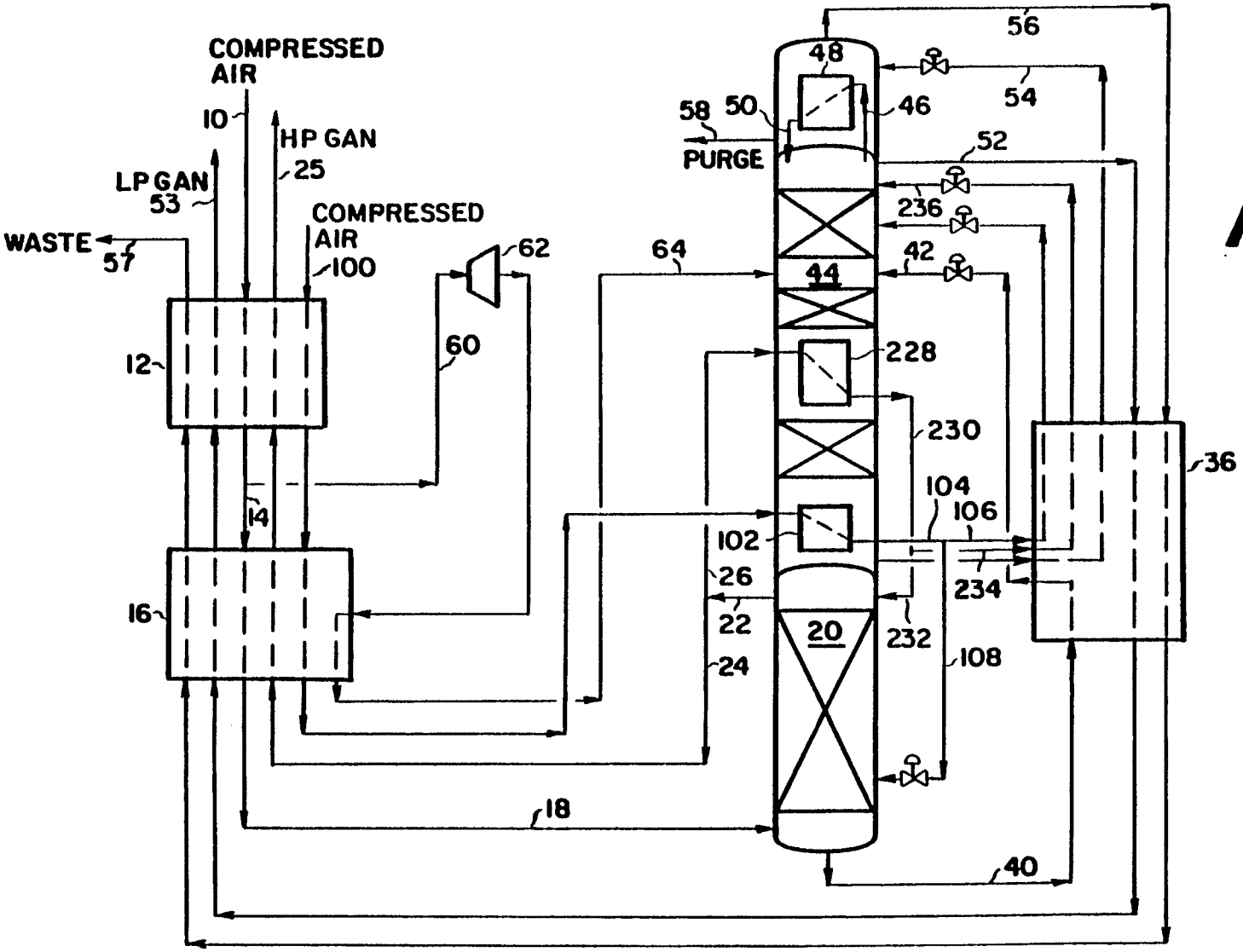
FIGS. 3–5 are flow diagrams of specific embodiments of the process of the present invention.

The invention in its simplest form is illustrated in FIG. 3. With reference to FIG. 3, a feed air stream, which has been compressed in a multistage compressor to 70–350 psia, aftercooled, processed in a molecular sieve unit to remove water and carbon dioxide, and split into two streams in lines 10 and 100. The flow rate of stream 100 is about 5–35% of total air feed flow. The first feed air stream, in line 10, is cooled in heat exchangers 12 and 16 and fed to the bottom of HP column 20 for rectification into a high pressure nitrogen overhead at the top of HP column 20 and a crude oxygen bottoms liquid at the bottom of HP column 20.

A portion of the feed air stream in line 10 is removed as a side stream and fed to, via line 60, and expanded in expander 62 to produce work and to provide a portion of the needed refrigeration for the process. This expanded side stream is further cooled and fed, via line 64, to a suitable location of LP column 44. The flow rate of the expanded stream 64 is between 5–20% of the flowrate of feed air stream 10 the exact amount is dependent upon the refrigeration needs of the process. The refrigeration requirements depend on plant size and the quantity of liquid products produced.

The crude oxygen bottoms liquid is removed from HP column 20, via line 40, subcooled in heat exchanger 36, reduced in pressure across an isenthalpic Joule-Thompson (JT) valve and fed, via line 42, to a suitable location in LP column 44.

The high pressure nitrogen overhead is removed from the top of HP column 20 and split into two portions, in lines 24 and 26, respectively. The flow rate of first portion of the high pressure nitrogen overhead, in line 24, is typically in the range of 5–50% and preferably in the range of 15–35% of the total feed air to the process. The first portion, in line 24, is then warmed in the main heat exchangers 16 and 12. The warmed high pressure nitrogen in line 24 is removed from the process as high pressure nitrogen product at a pressure close to the pressure of the feed air stream in line 10. The second portion of the high pressure nitrogen overhead in line 26 is condensed in intermediate reboiler/condenser 228 located in the upper part of the stripping section of LP column 44. A portion of the condensed nitrogen provides reflux to LP column 44 via line 236 after being subcooled in heat exchanger 36 and being fed to LP column 44. The remaining portion of the condensed nitrogen provides reflux to HP column 20 via line lOB. Flow rate of nitrogen in line 234 is 0–40% of the air feed to the HP column.

The various feeds to LP column 44 are distilled to produce a low pressure nitrogen overhead and an oxygen-enriched liquid. The oxygen-enriched liquid is removed from LP column 44, subcooled, reduced in pressure and fed, via line 54, to the sump surrounding reboiler/condenser 4B located at the top of LP column 44 wherein it is vaporized. The vaporized stream is removed via line 56, warmed in the heat exchangers 16 and 12 to recover refrigeration and typically vented as waste. Typically, a portion of this waste stream is used to regenerate the mole sieve beds. The concentration of oxygen in the oxygen-enriched liquid stream from the bottom of LP column 44 will be more than 50% and optimally in the range of 70–90%., its flow rate will be in the range of 23–40% of the feed air flow to the plant and preferably about 26–30% of the feed air flow. 5 about 26-30

A portion of the low pressure nitrogen overhead is condensed in the top reboiler/condenser 48 and is returned as reflux to LP column 44. Another portion is withdrawn as a low pressure nitrogen stream, in line 52, warmed in the heat exchangers 36, 16 and 12 to recover refrigeration and removed from the process as low pressure nitrogen product. The low pressure nitrogen product is typically in the pressure range of 35–140 psia with preferable range of 50–80 psia, and its flowrate is 20–70% of the total feed air stream to the process.

The second feed air stream, in line 100, is cooled in heat exchangers 12 and 16, totally condensed in the bottom reboiler/condenser 102 thereby providing the needed heat duty to provide reboil to LP column 44. A portion of this condensed feed air stream in line 104 is reduced in pressure and fed, via line 108, to a suitable location of HP column 20. Similarly, the remaining portion of the condensed feed air, in line 104, is subcooled, reduced in pressure and fed, via line 106, to a suitable location in LP column 44. While all the relative proportions of the condensed air stream 104 which was split into streams 106 and 108 are allowed, it is preferred that the flowrate of stream 108 be 30–70% of the stream 104 flowrate. The flowrate of stream 100 will be typically in the range of 5–35% of the total feed air flowrate to the process; with the preferred range being 10–25%.

The pressure of feed air stream 100 can be different from that of feed air stream 10. If the flow rate of stream 100 is small, the pressure of stream 10 can be potentially higher than that of stream 100. It is due to the fact that if the reboil provided in bottom reboiler/condenser 102 is small, then in order to avoid a pinch in LP column 44, the number of trays between intermediate reboiler/condenser 228 and bottom reboiler/condenser 102 are small. This implies that the difference in the temperatures of the boiling fluids in these two reboiler/condensers would be small. This leads to the condition that the pressure of the condensing air stream can be slightly lower than the condensing nitrogen pressure. As the reboil in the bottom reboiler/condenser is increased, the number of trays between the two reboiler/condensers is increased and the pressure of the feed air to the HP column, stream 10, be gradually decreased. For a certain split of reboiling between the two reboiler/condensers, the pressure of the condensing feed air stream 100 is same as that of feed air stream 10. As reboil is further increased in bottom reboiler/condenser 102, pressure of the feed air stream 10 becomes lower than feed air stream 100. In such a case, feed air stream 100 from a portion of stream 10 cc.;d be boosted in a compressor. This compressor could be driven by turbo-expander 62. However, the optimum reboil split between the two reboiler/condensers is such that the pressures of the two feed air streams are same. This simplifies the process and makes its operation easy.

Figure 5:
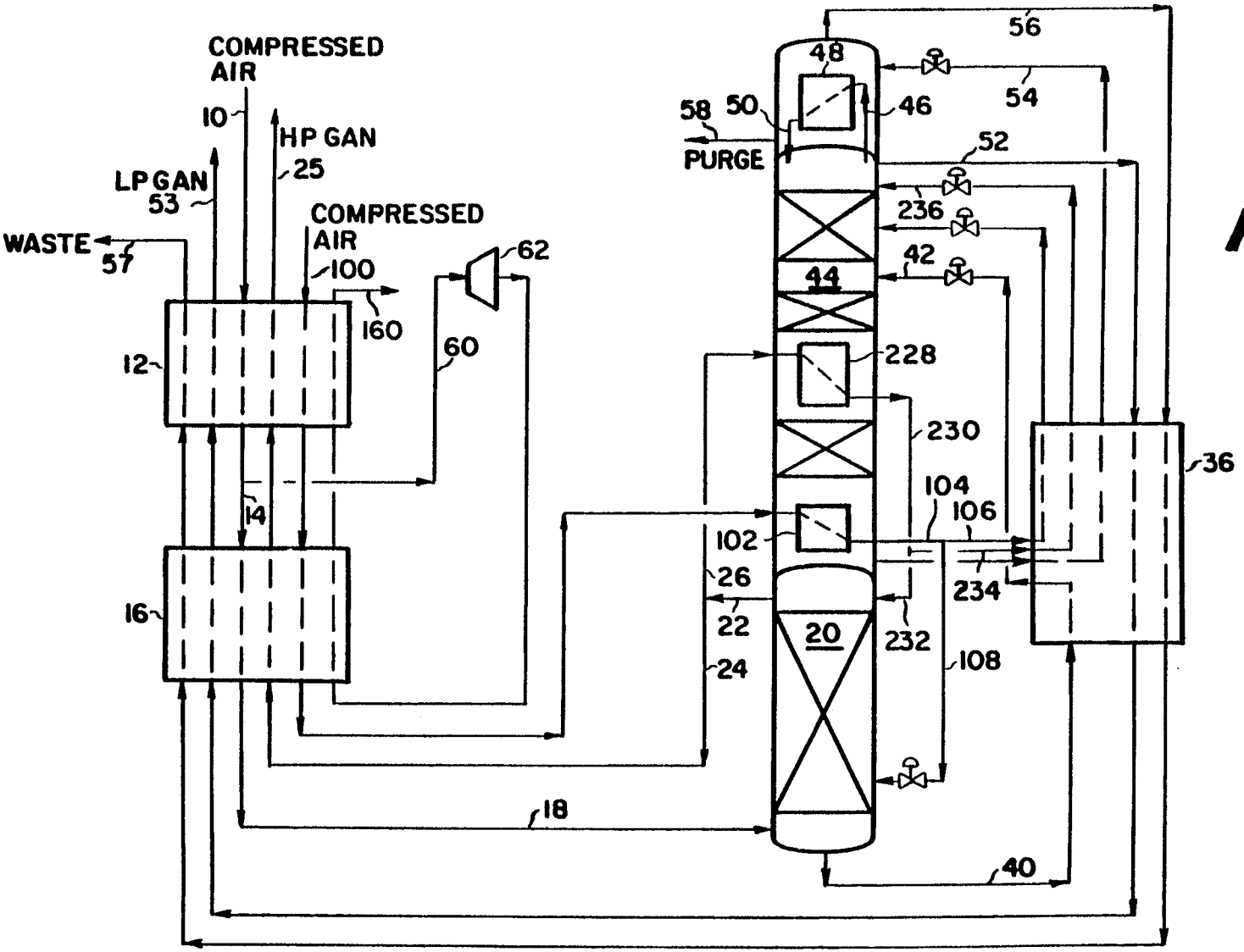

FIG. 3 demonstrates the main concept and many variation of it are possible. In FIG. 3, refrigeration was provided by expanding a portion of the feed air stream in a turbo-expander to the LP column. Alternatively, as shown in FIG. 5, this air stream (line 60) could be expanded (expander 62) to a much lower pressure and then warmed in heat exchangers 16 and 12 to provide low pressure stream 160. molecular sieve beds.

It is also possible to expand a stream other than the feed air for the refrigeration. For example, an oxygen-enriched waste stream from reboiler/condenser 48 can be expanded to provide the needed refrigeration. Alternatively, a portion of the high pressure nitrogen stream from the top of the HP column could be expanded to the LP column nitrogen pressure to meet the refrigeration requirement.

Figure 4:
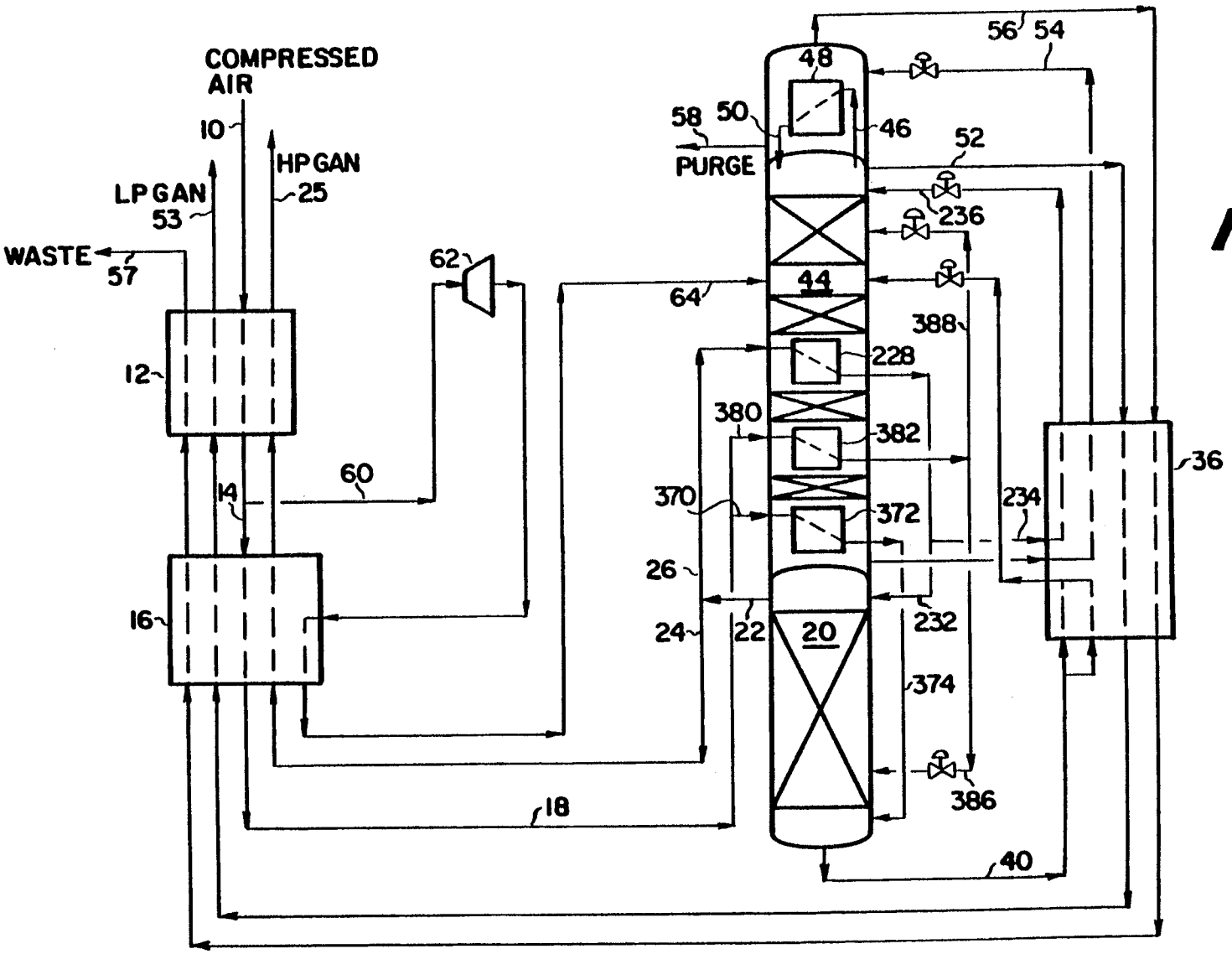

FIG. 4 shows another embodiment of the present invention where a third reboiler/condenser is added to the bottom section of the LP column. For simplification purposes, the feed air is shown as one stream entering heat exchanger 12 via line 10. This is equivalent to the case when the pressure of the two feed air streams 10 and 100 in FIG. 3 is same. With reference to FIG. 4, compressed air is fed to the process, via line 10, cooled in heat exchangers 12 and 16, and split into two portions in lines 370 and 380, respectively. The first portion, in line 370 is partially condensed in reboiler/condenser 372 located in the bottom of LP column 44, and subsequently fed to the bottom of HP column 20. The second portion, in line 3BO, is totally condensed in reboiler/condenser 382 and split into two further portions. The first further portion, in line 386, is reduced in pressure and fed to a location in HP column 20 a few trays above the feed of the partially condensed first portion, in line 374. The second further portion, in line 38B, is reduced in pressure and introduced to an upper intermediate location of LP column 44 as impure reflux. In addition, a portion of the cooled, compressed feed air is removed as a side stream via line 60. This side stream is expanded in turbo-expander 62, further cooled in heat exchanger 16, and subsequently fed, via line 64, to an intermediate location of LP column 44.

The two feeds, in lines 374 and 386, are rectified in HP column 20 into a high pressure nitrogen overhead and a crude oxygen bottoms liquid. The high pressure nitrogen overhead is removed, via line 22, from HP column 20, and split into two substreams. The first substream, in line 24, is warmed in heat exchangers 16 and 12 to recover refrigeration and then withdrawn as product. The second substream, in line 26, is condensed in reboiler/condenser 228 located in the upper portion of the stripping section of LP column 44. This condensed substream, is split and fed to the top of HP column 20 and LP column 44 via lines 232 and 234, respectively to provide pure reflux.

The crude oxygen bottoms liquid is removed from HP column 20, via line 40, subcooled in heat exchanger 36, reduced in pressure and then fed to an intermediate location of LP column 44 for distillation.

In LP column 44, the crude liquid oxygen stream, in line 40; the expanded feed air portion, in line 64, and the condensed feed air portion, in line 3BB, are distilled to produce a low pressure nitrogen overhead and an oxygen-enriched bottoms liquid. A portion of the low pressure nitrogen overhead is condensed in reboiler/condenser 48 and returned as pure nitrogen reflux. The remaining portion is removed from LP column 44, via line 52, as low pressure nitrogen product, which is subsequently warmed in heat exchangers 36, 16 and 12 to recover refrigeration. The low pressure nitrogen product is typically in the pressure range of 35–140 psia with preferable range of 50–80 psia, and its flowrate is 20–70% of the total feed air stream to the process.

A portion of the oxygen-enriched bottoms liquid is removed from LP column 44, reduced in pressure and fed, via line 54, to the sump surrounding reboiler/condenser 4B wherein it is vaporized. The oxygen-enriched vapor is then removed, via line 56, and warmed to recover refrigeration in heat exchangers 36, 16 and 12.

The embodiments described so far produce nitrogen product stream at two different pressures—one at the LP column pressure and the other at HP column pressure. As long as nitrogen product is needed at a pressure higher than the HP column pressure, the low pressure nitrogen stream can be compressed and mixed with the high pressure nitrogen fraction. However, in certain applications, the pressure of final nitrogen product can be lower than that of the HP column pressure but either equal to or higher than the LP column pressure. In such applications, for the processes described so far, the pressure of the high pressure nitrogen from the HP column will have to be dropped or all the nitrogen be produced at low pressure from the LP column. In either case, the process would become less efficient. In order to overcome this inefficiency, the concept of this invention should be combined with some of the features of the process of U.S. Pat. No. 4,543,115.

In this variation, taking for example FIG. 3, the feed air would be supplied to the cold box at two different pressures. One stream will be close to the HP column pressure and the other one would be close to the LP column pressure. The portion of air stream at low pressure, after cooling is directly fed to the LP column. No high pressure nitrogen is produced as product from the HP column. The amount of high pressure air to the HP column is Just enough to provide the needed liquid nitrogen reflux streams and the boilup in the stripping section of the LP column. This decreases the flowrate of the air stream needed at the HP column pressure and contributes to energy savings when product nitrogen stream is needed at a pressure lower than the HP column pressure. The rest of the configuration of FIG. 3 will remain unchanged.

FIGS. 3 and 4 use more than one reboiler/condenser in the bottom section of the LP column and this can add height to LP column 44. In certain cases, this increased height may be undesirable. For such applications all other intermediate reboiler/condensers except the top most intermediate reboiler/condenser, where nitrogen from the top of the HP column is condensed, can be taken out of the LP column and located in an auxiliary column. This auxiliary column can be located at any suitable height below the sump of the LP column. The bottom most reboiler/condenser 102 of FIG. 3 is moved to the bottom of the auxiliary column and the intermediate reboiler/condenser 22B is now located at the bottom of the LP column. Nitrogen from top of the HP column is now condensed in the reboiler/condenser located at the bottom of the LP column. The oxygen-rich liquid stream withdrawn from the bottom of the LP column is fed to the top of the auxiliary column by gravity. There are a few trays in the auxiliary column. The boilup at the bottom of this column is provided by totally condensing the air stream 100 in the reboiler/condenser located at the bottom of this column and the vapor stream from the top of this column is sent to the bottom of the LP column. The condensed liquid air stream is treated in a manner similar to stream 104 of FIG. 3. The diameter of the auxiliary column is much less than that of the LP column due to reduced vapor and liquid flowrates in this section.

The efficacy of the process of the present invention will now be demonstrated through following examples:

EXAMPLE 1

Calculations were done to produce nitrogen with oxygen concentration of about 1 vppm. Both high pressure and low pressure nitrogen streams were produced from the distillation columns and their proportions were adjusted to minimize the power consumption for each process cycle. In all these calculations, the basis was 100 moles of feed air and power was calculated as Kwh/short ton of product nitrogen. The final delivery pressure of nitrogen was always taken to be 124 psia and therefore the nitrogen streams from the cold box were compressed in a product nitrogen compressor to provide the desirable pressure. Turbo-expander 62 was normally taken to be generator loaded and credit for the electric power generated was taken in the power calculations.

Figure 1:
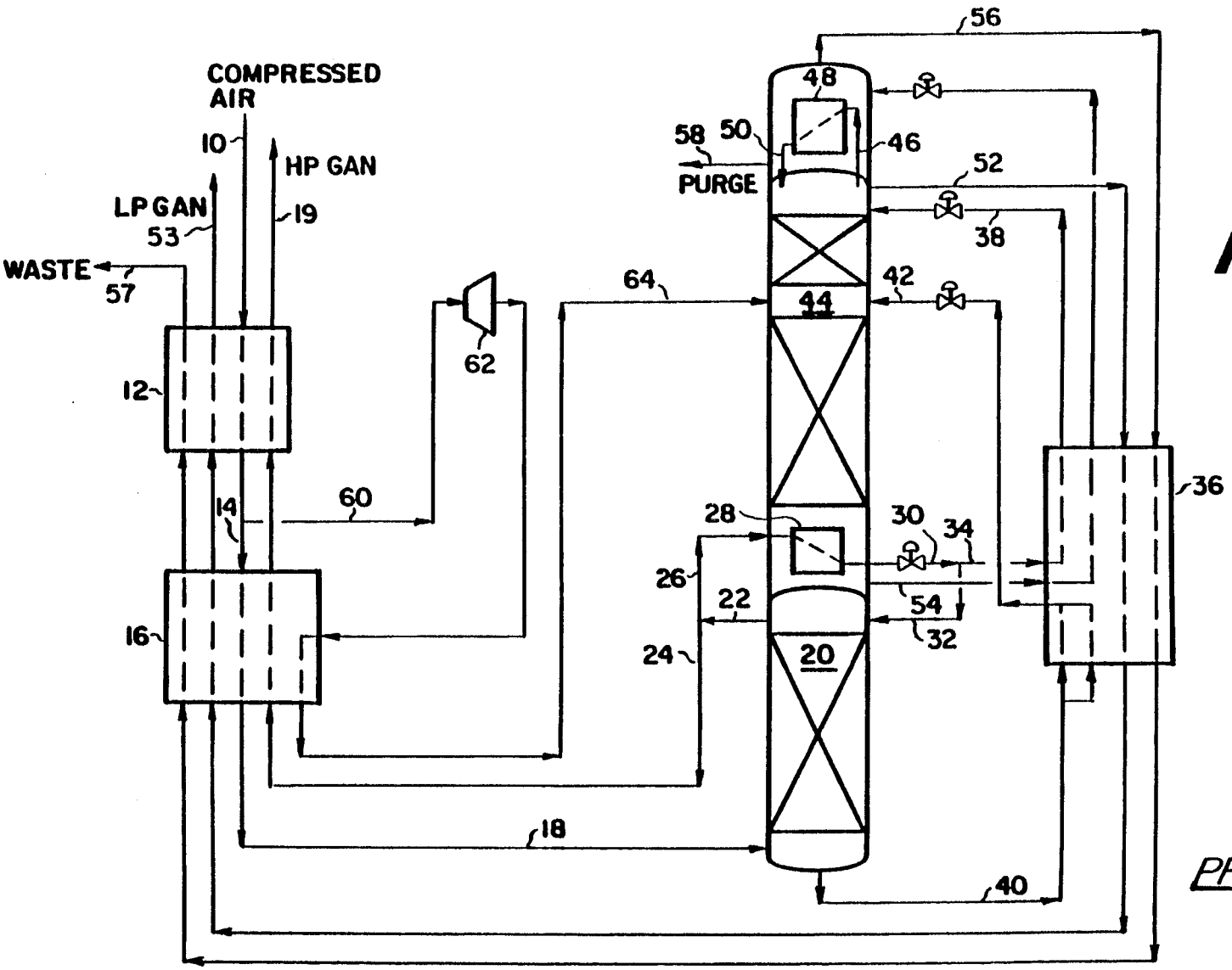
FIG. 1 PRIOR ART
FIG. 1 is a flow diagram of a process derived from the process disclosed in U.K. Pat. No. GB 1,215,377.

Calculations were first done for the process of FIG. 1. All the pertinent flowrates, temperatures, pressures and stream compositions are shown in Table 1. This provides the comparative basis for the prior art. It is observed that for this process 0.285 moles/mole of feed air is recovered as high pressure nitrogen at 124 psia and 0.425 moles/mole of feed air as low pressure nitrogen at 54 psia.

A number of calculation were done for the process of FIG. 3 by varying the flowrate of air stream 100 needed for boilup at the bottom of the LP column. This was done to vary the relative boilup between the two reboiler/condensers located in the stripping section of the LP column and to find the minimum in power consumption. The power consumptions for various cases are summarized in Table II.

TABLE I

| Stream Number | Temperature °F. | Pressure psia | Flowrate mol/hr | Composition: mol % Nitrogen | Oxygen | Argon |
|---|---|---|---|---|---|---|
| | | FIG. 1 Embodiment | | | | |
| 10 | 55 | 137 | 100.0 | 78.1 | 21.0 | 0.9 |
| 18 | −261 | 132 | 85.6 | 78.1 | 21.0 | 0.9 |
| 22 | −276 | 129 | 95.3 | 100.0 | 0.0 | 0.0 |
| 24 | −276 | 129 | 28.5 | 100.0 | 0.0 | 0.0 |
| 26 | −276 | 129 | 66.8 | 100.0 | 0.0 | 0.0 |
| 38 | −296 | 128 | 7.9 | 100.0 | 0.0 | 0.0 |
| 40 | −268 | 132 | 49.3 | 62.0 | 36.4 | 1.6 |

TABLE I-continued

| Stream Number | Temperature °F. | Pressure psia | Flowrate mol/hr | Composition: mol % Nitrogen | Oxygen | Argon |
|---|---|---|---|---|---|---|
| 42 | −287 | 63 | 49.3 | 62.0 | 36.4 | 1.6 |
| 46 | −295 | 60 | 35.0 | 100.0 | 0.0 | 0.0 |
| 52 | −295 | 60 | 42.5 | 100.0 | 0.0 | 0.0 |
| 56 | −297 | 18 | 28.8 | 24.7 | 72.1 | 3.2 |
| 60 | −165 | 135 | 14.3 | 78.1 | 21.0 | 0.9 |
| 64 | −274 | 63 | 14.3 | 78.1 | 21.0 | 0.9 |
| | | FIG. 3 Embodiment | | | | |
| 10 | 55 | 115 | 80.0 | 78.1 | 21.0 | 0.9 |
| 18 | −265 | 110 | 63.7 | 78.1 | 21.0 | 0.9 |
| 22 | −281 | 108 | 70.0 | 100.0 | 0.0 | 0.0 |
| 24 | −281 | 108 | 20.4 | 100.0 | 0.0 | 0.0 |
| 26 | −281 | 108 | 49.6 | 100.0 | 0.0 | 0.0 |
| 40 | −273 | 110 | 43.6 | 63.1 | 35.4 | 1.5 |
| 42 | −287 | 63 | 43.6 | 63.1 | 35.4 | 1.5 |
| 46 | −295 | 60 | 35.1 | 100.0 | 0.0 | 0.0 |
| 52 | −295 | 60 | 50.6 | 100.0 | 0.0 | 0.0 |
| 54 | −290 | 64 | 29.0 | 24.7 | 72.2 | 3.1 |
| 56 | −297 | 18 | 28.8 | 24.7 | 72.1 | 3.2 |
| 60 | −165 | 113 | 16.3 | 78.1 | 21.0 | 0.9 |
| 64 | −279 | 63 | 16.3 | 78.1 | 21.0 | 0.9 |
| 100 | 55 | 115 | 20.0 | 78.1 | 21.0 | 0.9 |
| 104 | −276 | 110 | 20.0 | 78.1 | 21.0 | 0.9 |
| 106 | −276 | 110 | 10.0 | 78.1 | 21.0 | 0.9 |
| 108 | −276 | 110 | 10.0 | 78.1 | 21.0 | 0.9 |
| 230 | −281 | 108 | 49.6 | 100.0 | 0.0 | 0.0 |
| 232 | −281 | 108 | 40.0 | 100.0 | 0.0 | 0.0 |
| 234 | −281 | 108 | 9.6 | 100.0 | 0.0 | 0.0 |
| 236 | −295 | 60 | 9.6 | 100.0 | 0.0 | 0.0 |

TABLE II

| Basis: | Nitrogen Product Pressure: 124 psia<br>Nitrogen Product Quality: 1 vppm $O_2$ | | | |
|---|---|---|---|---|
| | FIG. 1 | FIG. 3 Process | | |
| | Process | Case I | Case II | Case III |
| Stream 100 Flowrate* | — | 0.1 | 0.2 | 0.3 |
| Stream 10 Pressure** | 137 | 125 | 115 | 108 |
| Stream 100 Pressure** | — | 115 | 115 | 115 |
| Power: KwH/ton $N_2$ | 127.8 | 125.9 | 125.0 | 125.9 |
| Relative Power | 1.0 | 0.985 | 0.978 | 0.985 |

*moles/moles of total feed air
**psia

In Table II, the flowrate of the air stream 100 needed to provide the boilup at the bottom of the LP column is varied from 0.1 moles/mole of total feed air to 0.3 moles/mole of total feed air. In this table, for Case I when 0.1 moles of air per mole of total feed air is condensed in bottom reboiler/condenser 102 and its pressure is lower than the air feed to the HP column, the pressure of the total feed air was assumed to be the same (125 psia) for the power calculations. This was done because it is impractical to efficiently produce 10% of the total feed air stream at about 10 psi lower than the rest of the feed air stream by using another compressor or expander. Furthermore, this allowed the feeding of a portion of the condensed air stream to the HP column as impure reflux by gravity, y. For the case where 0.3 moles of air/mole of total feed air is condensed, the pressure of the condensing air stream was boosted by using a compressor. This booster-compressor was driven by the turboexpander 62 providing refrigeration to the plant.

As the flowrate of the condensing air stream is increased, the relative boilup in the bottom most reboiler/condenser of the LP column is increased. As expected there is an optimum split in the boilup duty needed by the two reboiler/condensers located in the bottom section of the LP column. When only a little boilup is provided in the bottom most reboiler/condenser, then the improvement in distillation is small. On the other hand, when a large fraction of boilup is provided in the bottom most reboiler/condenser then there is a greater loss of pure nitrogen reflux as a larger fraction of total feed air is condensed to liquid air providing too much impure reflux to the columns, which means an inefficient distillation. There is an optimum split of the boilup duty. As seen from Table 11, this optimum is achieved for the condensing air stream flowrate of about 0.2 moles/mole of total feed air. The optimum power is 2.2% lower than the prior art process of FIG. 1. For large tonnage plants this translates into substantial savings in variable cost of the nitrogen production.

Another observation to be made from Table II is that the minimum in power is achieved for the flowrate of the condensing air stream such that the total feed air can be supplied at one pressure to the cold box. This is desirable because it avoids the capital expenditure associated with the generation and handling of the feed air stream at two different pressures. The relevant process conditions for this optimum case are shown in Table I.

EXAMPLE 2 (Comparative example)

Figure 2:
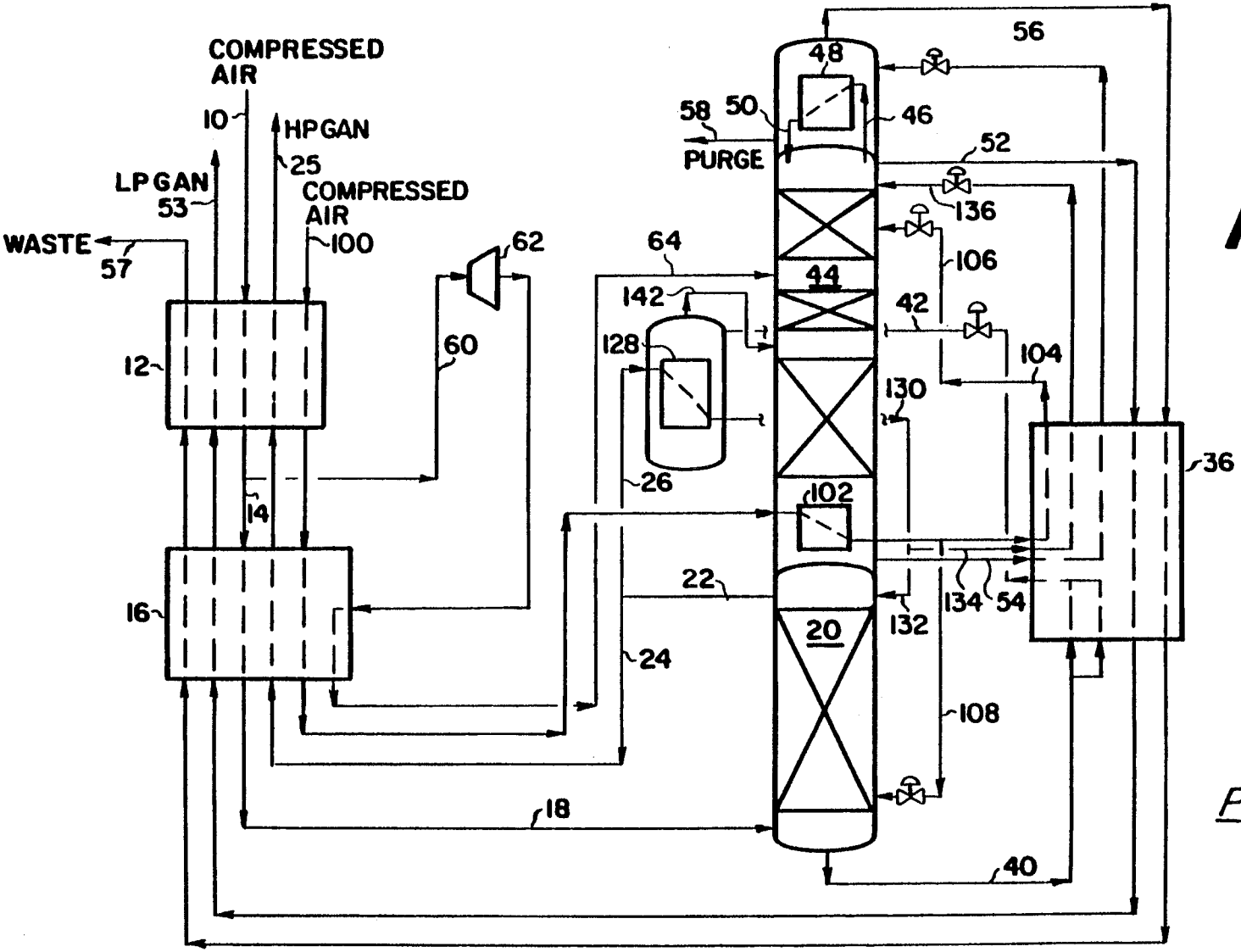
FIG. 2 PRIOR ART
FIG. 2 is a flow diagram of the process disclosed in U.S. Pat. No. 4,448,595.

The process taught by U.S. Pat. No. 4,448,595 (FIG. 2) was also simulated to produce nitrogen product with the same specifications as for Example 1. Due to the constraint that the nitrogen from the top of the HP column must be condensed against the crude LOX from the bottom of the HP column and all the crude LOX must be totally vaporized by the condensing nitrogen, the distillation in this process is quite inefficient. In order for the process to produce nitrogen at high recovery (0.71 moles/mole of total feed air), a large fraction of the feed air (37%) is to be condensed in the bottom reboiler/condenser of the LP column. This deprives the columns of pure reflux and makes the process inefficient. The power consumption for this case is 130.8 KwH/T of $N_2$. This is 2.4% more than the process of the prior art shown in FIG. 1 and 4.6% more than the process of current invention.

EXAMPLE 3 (Comparative Example)

Calculations were also done for the process of U.S. Pat. No. 4,582,518. Once again the product specifications were similar to the one described for Example 1. In this patent, air is partially condensed in the bottom reboiler/condenser of the LP column and fed to the bottom of the HP column. There is no impure reflux in the form of liquid air to the distillation columns. The power consumed by this process was about 129.5 Kwh/T of $N_2$ which is 1.3% more than the prior art process of FIG. 1 and 3.6% more than the process of present invention.

A summary of the power consumed by the various processes is shown in Table III. Clearly, the process of the present invention is the most efficient method of producing nitrogen.

TABLE III

Power Consumption Comparison

Basis: Nitrogen Product Pressure: 124 psia
Nitrogen Product Quality: 1 vppm $O_2$

| | Prior Art Processes | | | Present |
|---|---|---|---|---|
| | FIG. 1 | U.S. Pat. No. 4,448,595 | U.S. Pat. No. 4,582,518 | Invention Process* |
| Power KwH/T of $N_2$ | 127.8 | 130.8 | 129.5 | 125.0 |
| Relative Power | 1.0 | 1.023 | 1.013 | 0.978 |

*Case II from Table II

For large tonnage nitrogen plants, energy is the major fraction of the overall cost of nitrogen product. The present invention, by providing a method which reduces the power consumption by more than 2% over the prior art processes without much additional capital, provides attractive processes for such applications.

The present invention, by judiciously using more than one reboiler/condenser in the stripping section of the LP column, and also with the proper choice of the condensing fluids, decreases the irreversibility associated with the distillation of the prior art processes.

Two closest prior arts which use double distillation column system with more than one reboiler/condenser are U.S. Pat. Nos. 4,449,595 and 4,582,518. As discussed earlier, in U.S. Pat. No. 4,448,595, Cheung totally vaporizes the crude LOX from the bottom of the HP column against the high pressure nitrogen from the top of the HP column. The evaporated crude LOX has a composition within a narrow range (31–36% $O_2$) and therefore, it is as if the composition where intermediate boilup in the LP column is provided is almost fixed. Due to this location of the boiled vapor feed, in order to obtain reasonably high recoveries of nitrogen (such that nitrogen concentration is less than 25% in the liquid leaving the bottom of the LP column) it is required that a significantly larger fraction of feed air be condensed in the bottom reboiler/condenser of the LP column. This is done to create enough vapor in the bottom section of the LP column to avoid pinching. Condensation of a larger fraction of the feed air in the bottom reboiler/condenser deprives the column of pure nitrogen reflux and increases the fraction of low pressure nitrogen product from the LP column at reasonably high recoveries of nitrogen. This leads to large increase in the power needed by the nitrogen product compressor. On the other hand, if the proportion of the high pressure nitrogen product from the HP column is to be kept high, the total recovery of nitrogen is decreased. This increases the flow of air through the feed air compressor and this component of the overall power is increased. The net effect is that the overall power for this process is high. Another factor which contributes to this increase in power is the fact that crude LOX is totally vaporized and then fed as vapor to the LP column. This decreases the flexibility in adJusting the boilup distribution in the stripping section of the LP column to optimize the performance of this section of the LP column.

U.S. Pat. No. 4,582,518 obtained by Erickson removes the deficiency of Cheung's process by feeding crude LOX to a proper location in the LP column and locating the intermediate reboiler/condenser at an optimum location in the stripping section of this column. However, by only partially condensing air in the bottom reboiler/condenser, it eliminates the creation of liquid air and hence the impure reflux. Therefore, in this process, the decrease in amount of liquid nitrogen reflux is not compensated by the creation of an impure reflux stream. This increases the proportion of nitrogen product produced from the LP column and leads to increase in the power consumption by the nitrogen product compressor and hence of the overall process.

The present invention feeds all the crude LOX at an optimum location of the LP column. The intermediate reboiler/condenser is located at proper location in the stripping section of the LP column. A portion of the feed air is totally condensed in the bottom reboiler/condenser of the LP column. Therefore, while the use of these two reboiler/condensers with different condensing fluids decreases the production of pure nitrogen reflux, an impure reflux stream as liquid air is produced. The condensed liquid air is optimally split and fed to suitable locations in the HP and the LP columns. This helps to maintain the high recoveries of nitrogen with reasonably larger fraction of it being produced as high pressure nitrogen from the top of the HP column. The relative amount of boilups in the two reboiler/condensers not only effect the performance of the stripping section of the LP column but also control the relative quantities of liquid nitrogen and liquid air reflux streams. The relative quantity of these reflux streams effect the nitrogen recovery, specially the fraction of nitrogen recovered as high pressure nitrogen from the HP column. The current invention allows an independent control of the relative boilup in the two reboiler/condensers so as to achieve an overall optimum between all these factors and yields the lowest power consumption. This makes the present invention highly valuable.

The present invention has been described with reference to several specific embodiments thereof. These embodiments should not be viewed as a limitation on the scope of such invention; the scope of which is ascertained from the following claims.

We claim:

1. A cryogenic process for the production of nitrogen by distilling air in a double column distillation system comprising a high pressure column and a low pressure column comprising:

(a) cooling a first compressed feed air stream to near its dew point an rectifying the cooled, compressed feed air stream in the high pressure distillation column thereby producing a high pressure nitrogen overhead and a crude oxygen bottoms liquid, (b) removing the crude oxygen bottoms liquid from the high pressure distillation column subcooling the removed, crude oxygen bottoms liquid an :ding the subcooled, crude oxygen bottoms liquid to an intermediate location of the low pressure column for distillation;

(c) removing the high pressure nitrogen overhead from the high pressure column and dividing the removed, high pressure nitrogen overhead to a first and second portion;

(d) condensing the first portion of the high pressure nitrogen overhead in an intermediate reboiler/condenser located in the upper portion Of the stripping section of the low pressure column thereby providing at least a portion of the heat duty rreboil the low pressure column;

(e) warming the second portion of the high pressure nitrogen overhead to recover refrigeration thereby producing a high pressure nitrogen product;

(f) refluxing the high pressure column with at least a portion of the condensed nitrogen generated in step (d);

(g) cooling a second compressed feed air stream., totally condensing the cooled, second compressed feed air stream and dividing it into a first and second substream;

(h) feeding the first substream to a lower intermediate location of the high pressure column for distillation;

(i) reducing in pressure the second substream and feeding the reduced pressure, second substream to an upper intermediate location of the low pressure column for distillation; and (j) removing a low pressure nitrogen stream from the top of the low pressure column, warming the removed, low pressure nitrogen stream to recover refrigeration and recovering the warmed, low pressure nitrogen stream from the process as a low pressure nitrogen product.

2. The process of claim 1 which further comprises removing a portion of the cooled, first compressed feed air, and work expanding the removed portion.

3. The process of claim 2 which further comprises further cooling the expanded portion and feeding the further cooled expanded portion to an intermediate location of the low pressure column for distillation.

4. The process of claim 2 which further comprises warming the expanded portion to recover refrigeration and venting the warmed, expanded portion.

5. The process of claim 1 which further comprises removing and oxygen-enriched bottoms liquid from the bottom of the low pressure column; vaporizing the removed, oxygen-enriched bottoms liquid in a reboiler/condenser located in the top of the low pressure column against condensing low pressure nitrogen overhead thereby creating a oxygen-waste stream; and warming the oxygen-waste stream to recover refrigeration.

6. The process of clam 1 wherein the first compressed feed air stream and the second feed air stream at the same pressure.

7. A cryogenic process for the production of nitrogen by distilling air in a double column distillation system comprising a high pressure column and a low pressure column comprising:

(a) cooling a compressed air stream to near its dew point and dividing it into a first and second substream;

(b) partially condensing the first substream in a reboiler/condenser located in the bottom of the low pressure column and rectifying the partially condensed, first substream in the high pressure distillation column thereby producing a high pressure nitrogen overhead and a crude oxygen bottoms liquid;

(c) totally condensing the second substream in a reboiler/condenser located in lower section of the low pressure column at least one distillation stage immediately above the reboiler/condenser in the bottom of the low pressure column;

(d) dividing the condensed, second substream into two parts, a first part which is fed to a lower intermediate location of the high pressure column for distillation and a second part which is reduced in pressure and fed to an upper intermediate location of the low pressure column for distillation;

(e) removing the crude oxygen bottoms liquid from the high pressure distillation column, subcooling the removed, crude oxygen bottoms liquid and feeding the subcooled, crude oxygen bottoms liquid to an intermediate location of the low pressure column for distillation;

(f) removing the high pressure nitrogen overhead from the high pressure column and dividing the removed, high pressure nitrogen overhead into a first and second portion;

(g) condensing the first portion of the high pressure nitrogen overhead in an intermediate reboiler/condenser located in the upper portion of the stripping section of the low pressure column thereby providing at least a portion of the heat duty to reboil the low pressure column;

(h) warming the second portion of the high pressure nitrogen i overhead to recover refrigeration thereby producing a high pressure nitrogen product;

(i) refluxing the high pressure column with at least a portion of the condensed nitrogen generated in step (g); and (j) removing a low pressure nitrogen stream from the top of the low pressure column, warming the removed, low pressure nitrogen stream to recover refrigeration and recovering the warmed, low pressure nitrogen stream from the process as a low pressure nitrogen product.

8. The process of claim 7 which further comprises removing a portion of the cooled, first compressed air, and work expanding the removed portion.

9. The process of claim 8 which further comprises further cooling the expanded portion and feeding the further cooled expanded portion to an intermediate location of the low pressure column for distillation.

10. The process of claim 8 which further comprises warming the expanded portion to recover refrigeration and venting the warmed, expanded portion.

11. The process of claim 7 which further comprises removing an oxygen-enriched bottoms liquid from the bottom of the low pressure column; vaporizing the removed. oxygen-enriched bottoms liquid in a reboiler/condenser located in the top of the low pressure column against condensing low pressure nitrogen overhead thereby creating a oxygen-waste stream; and warming the oxygen-waste stream to recover refrigeration.

* * * * *

PRINTER'S TRIM LINE

UNITED STATES PATENT AND TRADEMARK OFFICE

CERTIFICATE OF CORRECTION

PATENT NO. : 5,006,137

DATED : April 9, 1991

INVENTOR(S) : Rakesh Agrawal and Donald W. Woodward

It is certified that error appears in the above-identified patent and that said Letters Patent is hereby corrected as shown below:

Column 15, Line 52
Delete "an :ding" and substitute therefor -- and feeding --

Column 15, Line 58
Delete "to" and substitute therefor -- into --

Column 15, Line 62
Delete "Of" and substitute therefor -- of --

Column 15, Line 64
Delete "rreboil" and substitute therefor -- to reboil --

Column 16, Line 4
Delete "." and substitute therefor -- ; --

Column 16, Line 32
Delete "and" and substitute therefor -- an --

Column 16, Line 40
Delete "clam" and substitute therefor -- claim --

UNITED STATES PATENT AND TRADEMARK OFFICE

CERTIFICATE OF CORRECTION

PATENT NO. : 5,006,137

DATED : April 9, 1991

INVENTOR(S) : Bakesh Agrawal et al

It is certified that error appears in the above-identified patent and that said Letters Patent is hereby corrected as shown below:

Column 16, Line 41
Delete "stream at" and substitute therefor -- stream are at --

Column 17, Line 18
Delete "nitrogen i overhead" and substitute therefor -- nitrogen overhead --

Column 18, Line 6
Delete "compressed air" and substitute therefor -- compressed feed air --

Signed and Sealed this

Fifteenth Day of September, 1992

*Attest:*

DOUGLAS B. COMER

*Attesting Officer*

*Acting Commissioner of Patents and Trademarks*